US009617761B2

(12) United States Patent
Scholz et al.

(10) Patent No.: US 9,617,761 B2
(45) Date of Patent: Apr. 11, 2017

(54) MOTOR VEHICLE DOOR LOCK

(71) Applicant: Kiekert Aktiengesellschaft, Heiligenhaus (DE)

(72) Inventors: Michael Scholz, Essen (DE); Oliver Goetz, Essen (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 0 days.

(21) Appl. No.: 14/780,576

(22) PCT Filed: Mar. 11, 2014

(86) PCT No.: PCT/DE2014/000109

§ 371 (c)(1),
(2) Date: Dec. 11, 2015

(87) PCT Pub. No.: WO2014/154192

PCT Pub. Date: Oct. 2, 2014

(65) Prior Publication Data

US 2016/0108647 A1 Apr. 21, 2016

(30) Foreign Application Priority Data

Mar. 28, 2013 (DE) ..... 10 2013 103 245

(51) Int. Cl.
*E05B 85/26* (2014.01)
*E05B 79/10* (2014.01)
(Continued)

(52) U.S. Cl.
CPC ..... *E05B 79/10* (2013.01); *E05B 81/14* (2013.01); *E05B 85/243* (2013.01); *E05B 85/26* (2013.01); *E05B 77/36* (2013.01)

(58) Field of Classification Search
CPC ..... E05B 17/0029; E05B 81/00; E05B 81/04; E05B 81/14; E05B 85/26; Y10S 292/23
(Continued)

(56) References Cited

U.S. PATENT DOCUMENTS 5,971,448 A * 10/1999 Hayakawa ..... E05B 85/243 292/216
6,386,599 B1 * 5/2002 Chevalier ..... E05B 81/14 292/201
(Continued)

FOREIGN PATENT DOCUMENTS

CA 2788576 * 8/2011
DE 10312093 A1 3/2004
(Continued)

OTHER PUBLICATIONS

Machine Translation of DE10312093A1 by Lexis Nexis Total Patent on Dec. 7, 2015.
(Continued)

*Primary Examiner* — Janet M Wilkens
(74) *Attorney, Agent, or Firm* — Woodard, Emhardt, Moriarty, McNett & Henry LLP

(57) ABSTRACT

The disclosure relates to a motor vehicle door lock, having a locking mechanism that includes a rotary latch and at least one pawl. A drive for acting on the locking mechanism is also provided. A blocking element which interacts with the pawl has at least one pawl arm which holds the pawl in a latching position. Finally, a stop arm is realized on the blocking element and/or on the pawl and/or on a release element, the stop arm acting as a stop for the drive. The blocking element is arranged on an edge which is averted from the rotary latch and also so as to laterally overlap the pawl.

17 Claims, 1 Drawing Sheet

(51) Int. Cl.
*E05B 81/14* (2014.01)
*E05B 85/24* (2014.01)
*E05B 77/36* (2014.01)

(58) Field of Classification Search
USPC ..... 292/201, 216
See application file for complete search history.

(56) References Cited

U.S. PATENT DOCUMENTS

| | | | | |
|---|---|---|---|---|
| 8,388,029 | B2 * | 3/2013 | Pecoul | E05B 85/243 292/201 |
| 8,764,075 | B2 * | 7/2014 | Taurasi | E05B 81/14 292/201 |
| 2003/0038485 | A1 * | 2/2003 | Schwaiger | E05B 81/14 292/201 |
| 2004/0227358 | A1 | 11/2004 | Kachouh | |
| 2005/0146144 | A1 * | 7/2005 | Brose | E05B 81/14 292/201 |
| 2006/0076784 | A1 * | 4/2006 | Kachouh | E05B 49/00 292/216 |
| 2006/0279090 | A1 * | 12/2006 | Ottino | E05B 85/26 292/216 |
| 2008/0203737 | A1 * | 8/2008 | Tomaszewski | E05B 77/26 292/216 |
| 2010/0052336 | A1 | 3/2010 | Bendel et al. | |
| 2011/0074166 | A1 * | 3/2011 | Taurasi | E05B 81/14 292/27 |
| 2011/0169280 | A1 | 7/2011 | Scholz et al. | |
| 2011/0204690 | A1 | 8/2011 | Torkowski et al. | |
| 2012/0175896 | A1 | 7/2012 | Vittone et al. | |
| 2012/0181798 | A1 * | 7/2012 | Margheritti | E05B 77/32 292/200 |
| 2013/0127182 | A1 * | 5/2013 | Bendel | E05B 85/26 292/200 |
| 2014/0049056 | A1 * | 2/2014 | Scholz | E05B 81/14 292/200 |
| 2015/0233157 | A1 * | 8/2015 | Bendel | E05B 85/243 292/199 |
| 2015/0300052 | A1 * | 10/2015 | Barmscheidt | E05B 77/02 292/201 |
| 2015/0308165 | A1 * | 10/2015 | Scholz | E05B 85/26 292/199 |
| 2015/0315824 | A1 * | 11/2015 | Gotzen | E05B 77/06 292/200 |

FOREIGN PATENT DOCUMENTS

| | | | |
|---|---|---|---|
| DE | 102008048712 | A1 | 3/2010 |
| DE | 102011100552 | A1 | 11/2011 |
| DE | 202011100643 | U1 | 10/2012 |
| EP | 1477627 | * | 5/2004 |
| EP | 1460211 | A2 | 9/2004 |
| EP | 2161398 | A2 | 3/2010 |
| WO | 0133017 | * | 5/2001 |
| WO | 2008/061491 | A1 | 5/2008 |
| WO | 2009/149684 | A1 | 12/2009 |

OTHER PUBLICATIONS

Machine Translation of DE202011100643U1 by Lexis Nexis Total Patent on Dec. 7, 2015.

* cited by examiner

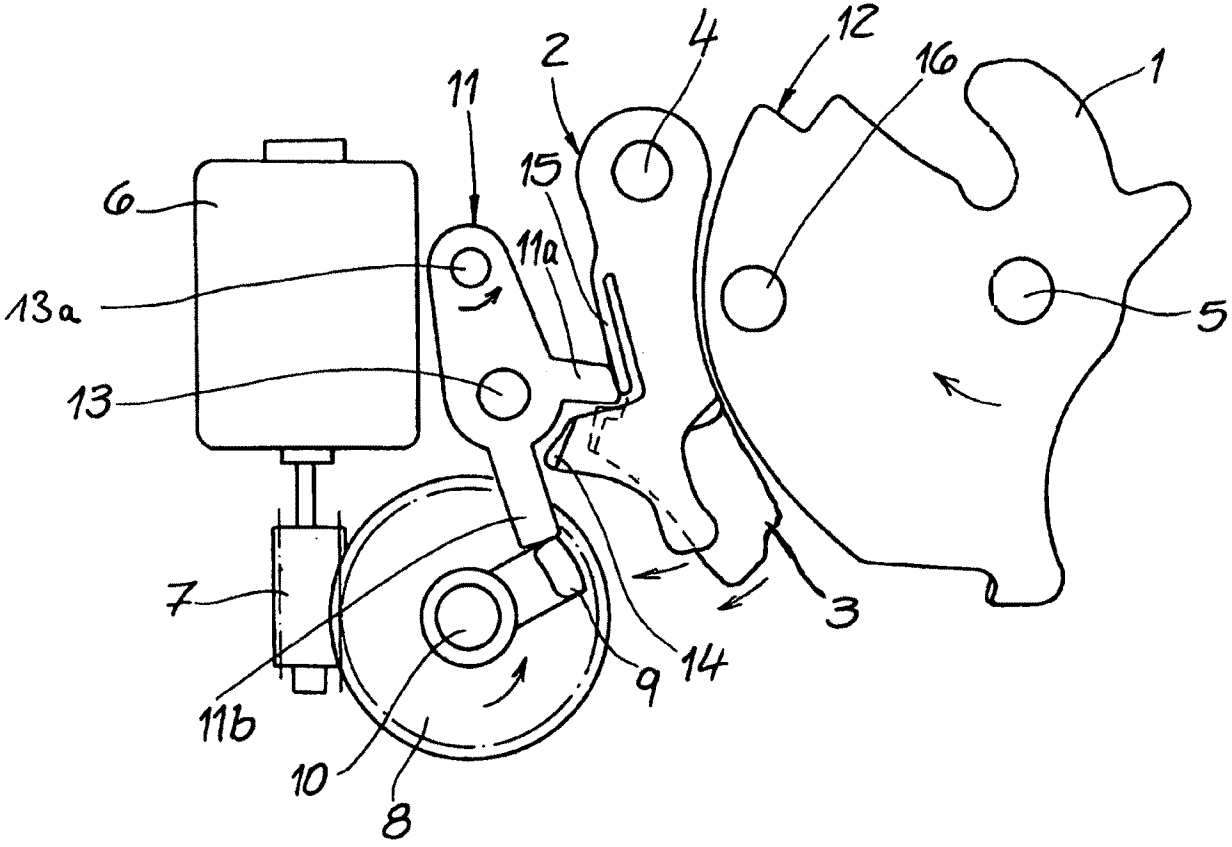
1
5
16
12
3
4
14
2
15
11a
9
11
8
10
11b
7
6
13a
13

MOTOR VEHICLE DOOR LOCK

CROSS-REFERENCE TO RELATED APPLICATIONS

This application is the U.S. national stage application of International Patent Application No. PCT/DE2014/000109, filed Mar. 11, 2014, which claims priority of German Application No. 10 2013 103 245.1, filed Mar. 28, 2013, which are both hereby incorporated by reference.

BACKGROUND

The invention relates to a motor vehicle door lock, having a locking mechanism comprising substantially a catch and a pawl, as well as a drive for acting on the locking mechanism and a blocking element interacting with the pawl and having at least one pawl arm and a drive arm, with the pawl arm holding the pawl in a latching position and the drive arm acting as a stop for the drive. The drive arm or the stop arm is provided on the blocking element and/or the pawl and/or on a release element.

A motor vehicle door lock of the aforementioned design is disclosed in DE 103 12 093 B4, in form of a catch lock, in which the pawl is moved into its release position by means of a control element containing an electric motor as its drive. This is the normal functionality during so-called "electric opening".

In case of a so-called opening obstruction, the catch cannot automatically disengage the previously engaged locking bolt, despite being released. Such an opening obstruction occurs, for instance, where the respective lock or rear lock of the trunk lid or the actual trunk lid is frozen. In order to prevent the electric motor from continuing to turn in such a situation, as part of the described opening process, the electric motor is blocked by a stop journal of a blocking cam moving against a blocking surface of a stopping arm of the engaging lever. This means that in DE 103 12 093 B4, the provided engaging lever or the blocking element prevent the continued turning of the electric motor during an opening process, in particular in the event that the trunk lid is blocked as in the example. This design has generally proven to be successful.

As part of the generic teaching disclosed in DE 103 12 093 B4, said blocking element or the engaging lever is arranged in a space between the pawl and the catch. Such an arrangement can be easily implemented in the known and relatively elaborate and large pawl does however create problems where special pawl arrangements are required. The latest trend is to move increasingly towards the use of so-called multi-pawl and, in particular, dual-pawl locking mechanisms as disclosed in DE 10 2008 048 712 A1, DE 20 2011 100 643 U1 and, in particular, in WO 2008/061491 A1 of the Applicant, representing the original design.

Such a multi-part pawl or multi-pawl locking mechanisms have the advantage that the locking mechanism is particularly quiet. In order to achieve this, a first and a second pawl are generally provided. The first pawl or so-called comfort pawl typically interacts with a main ratchet of the catch, whilst the second pawl or pre-ratchet pawl engages in a pre-ratchet of the catch. This pre-ratchet is, in most cases, defined by a contour or a pin on the catch.

Such multi-pawl locking mechanisms are in most cases designed in such a way that at least the comfort pawl or the first pawl are more or less automatically lifted off the catch during its opening, when the second pawl, responsible for the pre-ratchet, has been disengaged. This means that the catch generates an opening movement as regards the first pawl or comfort pawl, so that it is easily and basically automatically and quietly or more or less quietly moved into the open position as a result of the spring bias of the catch. The spring bias is provided by a spring assigned to the catch, pretensioning the catch in the opening sense.

Within the industry such multi-pawl locking mechanisms are becoming more and more popular as they are significantly quieter. The near automatic opening movement of the first pawl or of the comfort pawl, generated by the opening catch is very quiet or even completely silent. The industry is also looking for electric opening drives that can, for instance, be combined with a "Keyless Entry" system. So far, no convincing concepts are available that combine the described electric opening with a multi-pawl locking mechanism and that also contain a design that can be implemented. The invention aims to remedy this.

SUMMARY

The invention is based on the technical problem of further developing said motor vehicle door lock in such a way that the drive can be optionally combined with a multi-pawl locking mechanism, whilst also providing a compact and cost-effective design.

In order to solve this technical problem, a generic motor vehicle door lock of the invention is characterized by the blocking element being arranged on an edge facing away from the catch and laterally overlapping the pawl.

The first advantage of the embodiment is its compact design. This is aided by the fact that according to an advantageous embodiment, the blocking element is arranged or can be positioned between the pawl, on one hand, and the drive or an electric motor being a component of the drive, on the other hand. In addition, a worm wheel is provided as a further component of the drive that is generally arranged below or on the side of the blocking element.

This ensures, first of all that sufficient space is provided at the periphery of the catch in order to be able to arrange a second pawl or pre-ratchet pawl in this area in addition to the first pawl or comfort pawl, as required. As already described with reference to the state of the art, the comfort pawl typically interacts with a main ratchet of the catch, whilst the pre-ratchet pawl interacts with a pre-ratchet of the catch. This pre-ratchet can generally be designed as a further ratchet on the catch. The pre-ratchet is, however, generally defined by a contour or pin, protruding from the catch or projecting upwards from the catch.

In order to open the locking mechanism, the drive typically acts on a release lever. In a first step, the release lever uncouples the pre-ratchet pawl so that it can no longer interact with said contour or the pin on the catch. As soon as the pre-ratchet pawl is or has been raised compared to the catch, the pre-ratchet pawl acts, for instance and in addition on the blocking element that mainly has retained the comfort pawl in its latching position during the described process.

As a result, the blocking element and its pawl arm are pivoted away from the pawl or comfort pawl so that the catch, opened by the force of the spring, disengages and can disengage the comfort pawl. This is generally achieved by a so-called notch or by the fact already described with reference to WO 2008/061491 A1, that the catch exerts a force on the comfort pawl or first pawl or generates a torque on the pawl, assisting the release of the catch. This means that the catch applies an opening moment on the pawl or respective comfort pawl, the so-called "notch". As a result, the pawl or the comfort pawl can leave the main ratchet silently or at least quietly allowing the catch and thus the locking mechanism as a whole to move into its "open" position.

The aforementioned functionality and the particularly quiet opening of the locking mechanism are naturally also ensured when the motor vehicle door lock of the invention only contains one pawl. In this case the drive ensures that the blocking element is pivoted away from the respective pawl for opening of the locking mechanism. As a result, the pawl arm of the blocking element cannot (no longer) hold the pawl in its latching position or main ratchet position. This is ensured by the drive, which in this context acts on the drive arm accordingly for pivoting the blocking element. As a result, the catch can execute another opening moment on the pawl or the catch uses said "notch" for the interaction with the respective pawl. After the pawl has been disengaged in relation to the catch, the pawl moves independently out of the latching position or main ratchet position and silently or very quietly releases the catch. This is primarily ensured by the opening moment exerted by the catch on the pawl.

According to the invention, the blocking element also acts as a stop for the drive. This means that the drive is decelerated or stopped during the described opening movement with the aid of the blocking element. This is ensured by the drive arm or stopping arm of the blocking element, also acting as a stop for the drive. This prevents the release lever, acted upon by the drive for pivoting the blocking element, from being moved too early back into its starting position. This could result in an undefined state. Such an undefined state corresponds, for instance, to the pre-ratchet position being assumed too early, stopping the latch from being opened.

The blocking element provides in any case, as it were, a double function—on one hand as a detent lever or for defining the ratchet position or main ratchet position of the locking mechanism—and on the other hand as a stop for the drive. At the same time, the embodiment also provides a compact and cost-effective design, as according to the invention, the blocking element is located on the edge of the pawl averted from the catch and thus on the edge facing the catch, being the edge opposite the edge of the pawl. Also, the blocking element and the pawl are arranged to laterally overlap, resulting in the blocking element and the pawl being arranged more or less parallel to one another. These are then main advantages.—The same advantages are achieved if the drive arm or stopping arm is provided as an alternative or as an addition on the pawl and/or the release element.

In detail, the pawl arm and the drive arm of the blocking element advantageously produce a right angle. On one hand, this allows the pawl arm to keep the pawl in its latching position and on the other hand, the drive arm protruding essentially perpendicularly, can be easily acted upon by the drive. The drive either directly acts on the respective drive arm for pivoting the blocking element or indirectly on the drive arm. The letter version corresponds to the drive pivoting the blocking element with the aid of the pre-ratchet pawl by means of said release lever and the pre-ratchet pawl. Alternatively, the release lever can also act on the blocking element in order to pivot it.

In its position releasing the pawl, the pawl arm of the blocking element lies advantageously against an extension of the pawl. This extension can be a spring extension on the pawl. In this way, the opening movement of the pawl caused by the catch is decelerated. This opening movement of the pawl occurs against the force of the spring extension and is thus slowed down or decelerated.

Naturally, the design is such that the opening moment exerted by the catch on the pawl overcomes and can overcome any (counter) spring forces of the spring extension. At the same time, the pawl arm is also retained in a defined position, i.e. resting against the extension or spring extension of the pawl in its position releasing the catch. Any undefined positions of the blocking element can thus, already in principle, not occur.

This is also significant given that the stopping arm of the blocking element generally, at least partly, overlaps the said drive wheel or worm wheel of the drive. In this context, the worm wheel advantageously contains a radial projection, rising up from the respective worm wheel, taking into account a specified angle of rotation and at a certain radial distance in relation to the axis of rotation of the drive wheel or worm wheel. The radial projection moves against the stopping arm of the blocking element as soon as the drive has completed the described opening movement in the example.

In order to ensure that the radial projection, on one hand and the stopping arm of the blocking element, on the other hand, "meet" during this process, it is important that after the released of the pawl, the blocking element assumes a defined position in relation to its axis of rotation. This is ensured, amongst other things, by the already described interaction between the pawl arm of the blocking element and the extension or spring extension on the respective pawl. The blocking element furthest away from the pawl can, in any case, continue its further function as stop for the drive without problem. This applies at least in the event that the blocking element does not (no longer) retain the pawl in its latching position or main ratchet position.

As already explained above, the motor vehicle door lock of the invention is suitable for applications containing a pawl and is also particularly suitable for so-called multi-pawl locking mechanism. The embodiment offers, in any case, particularly low-noise opening operations initiated by the drive, i.e. electric operation. In case of a multi-pawl locking mechanism, a first and a second pawl are provided. The first pawl is typically a comfort pawl, interacting with the main ratchet of the catch. In contrast, the second pawl is a pre-ratchet pawl, generally interacting with said contour or the pin, rising up from the catch.

The stop or drive arm for the electric drive is generally provided on the said blocking element interacting with the first pawl or comfort pawl. Such a stopping arm or drive arm, also functioning as a stop for the drive can, however, also be provided directly by the respective pawl or first pawl. This means that in this case the pawl itself acts as a stop or carries out the stop function and features said stopping arm for this purpose.

Alternatively or in addition, also the release element or the release lever can contain the respective drive arm or stopping arm. Where the stopping arm is to be provided on the pawl, the stopping arm can be arranged on the comfort pawl and on the pre-ratchet in case of a multi-pawl locking mechanism, which are all covered by the invention. Such an arrangement resolves any functional problems. In the invention, situations cannot (no longer) occur in which the drive is stopped despite the locking mechanism still being in a pre-ratchet position. In such a situation, the associated motor vehicle door lock would first have to be initially moved into the main ratchet position before another opening operation is carried out. This is practically excluded by the invention. These are the main advantages.

BRIEF DESCRIPTION OF THE DRAWING

Below, the invention is explained with reference to only one drawing showing only one embodiment. The only FIGURE shows an overview of an inventive motor vehicle door lock, reduced to the components essential for the invention.

DETAILED DESCRIPTION OF THE DRAWING

The only FIGURE shows a motor vehicle door lock containing as usual a locking mechanism 1, 2, 3 comprising essentially a catch 1 and one or more pawls 2, 3. The locking mechanism 1, 2, 3 interacts with a locking bolt, not shown, that may be arranged on the motor vehicle chassis. In contrast, the shown motor vehicle door lock is typically arranged inside a motor vehicle door and, in the example, inside a trunk lid. The lock is thus a trunk lid lock which can, however, in principle also be used for a motor vehicle side door, i.e. as a side door lock.

The only FIGURE shows that the locking mechanism 1, 2, 3 comprises said catch 1 and two pawls 2, 3, which only serves as an example and does not restrict the invention. For this reason only a first pawl 2 or comfort pawl 2 is depicted as a continuous line, with the second pawl 3 being shown as an option and the pre-ratchet pawl by a dashed line. It is apparent that the two pawls 2, 3 are arranged in planes above each other. Both pawls 2, 3 are also rotatably mounted around a rotary axis 4. The catch 1 is also rotatably mounted around a rotary axis 5.

The further basic arrangement includes a drive 6, 7, 8, 9. The drive 6 to 9 is an electric drive with the aid of which the locking mechanism 1, 2, 3 is electrically opened in the example, for instance after a "Keyless entry" routine. For this purpose, the drive 6 to 9 comprises an electric motor 6, a worm 7 connected to the drive shaft of the electric motor 6, a worm wheel 8 and lastly, a projection or radial projection 9 on the worm wheel 8.

As usual, the rotations of the electric motor 6 are transferred to the worm 7 at its drive shaft, which in turn is in engagement with the worm wheel 8, pivoting it in clockwise direction or counter-clockwise direction in relation to an associated axis 10. The radial projection 9 is connected to the worm wheel 8 taking into consideration a certain angle of rotation in relation to axis 10 or projects from the worm wheel 8. The radial projection 9 also has a certain radial distance to the respective axis 10.

Of further special significance is a blocking element 11 interacting with the pawl 2, 3. The blocking element 11 contains a pawl arm 11*a*, holding the pawl 2, 3 in a latching position. In the embodiment, the pawl arm 11*a* ensures that the comfort pawl 2 is maintained in the main ratchet position. The comfort pawl 2 then engages in a main ratchet 12 on the catch 1 in the closed position of the locking mechanism 1, 2, 3. This is not shown in the example. In the shown open position, the blocking element 11 releases the pawl 2, 3 or the comfort pawl 2. For this purpose, the blocking element 11 has been pivoted from its detent position or the comfort pawl 2 in the main ratchet 12 of the catch 1 has been pivoted around its axis 13 into the shown release position and in counter-clockwise direction. In the detent position, the pawl arm 11*a* of the blocking element 11 rests against a stop 14 of the comfort pawl 2 of the example.

In addition to the aforementioned pawl arm 11*a*, the blocking element 11 contains a stopping arm 11*b*, with the aid of which the movements of the worm wheel 8 can be restricted, i.e. in the counter-clockwise opening process still to be described in detail so that, as a result, the pawl arm 11*a* is released from the stop 14 on the comfort pawl 2. Subsequently, the comfort pawl 2 is also released from the main ratchet 12 of the catch 1. The blocking element 11 also serves to accommodate a bearing axis 13 for elements of the lock that are not shown. The blocking element 11 pivots around axis 13*a*.

As the catch 1 is pretensioned by a spring in the opening sense—not shown—i.e. in the direction of a clockwise rotation in relation to its axis 5 and can also contain the "notch" described in the introduction, the opening catch 1 exerts an opening torque on the pawl or the comfort pawl 2 in the example. This means that the comfort pawl 2 is disengaged from the main ratchet 12 by the opening catch 1 and particularly easily and silently.

In order for the drive 6 to 9 to assume a defined end position after initiation of an electric opening operation, described below, the stopping arm 11*b* also functions at the blocking element 11 as a stop for the respective drive 6 to 9. This position is shown in the FIGURE. During the described opening operation, the drive 6 to 9 is actually stopped by the radial projection 9 moving against the stopping arm 11*b* of the blocking element 11 during an associated counter-clockwise movement of the worm wheel 8 around its axis 10 and in the release position of the blocking element 11.

It is apparent that the pawl arm 11*a* and the stopping arm 11*b* of the blocking element 11 more or less form a right angle to each other. As a result, the pawl arm 11*a* can, on one hand, easily interact with the stop 14 of the pawl or comfort pawl 2 whilst the stopping arm 11*b* also functions as a stop for drive 6 to 9 or the radial projection 9.

In the released position of the blocking element 11 shown in the FIGURE in relation of the pawl or comfort pawl 2, the pawl arm 11*a* of the blocking element 11 rests against an extension 15 of the pawl or comfort pawl 2. In the embodiment, the extension 15 is a spring extension 15. As a result, the pawl or comfort pawl 2, on one hand, and the blocking element 11, on the other hand, are fixed in their respective positions and are dampened with the aid of the spring extension 15. At the same time, the spring extension 15 ensures that the pawl or the comfort pawl 2 are softly slowed down during the opening operation.

As described, this opening operation of the pawl or comfort pawl 2 corresponds to the opening catch 1 moving the pawl or the comfort pawl 2 as a result of the "notch" out of the main ratchet 12. The pivoting movement of the pawl or comfort pawl 2 is slowed down with the aid of the spring extension 15 moving against the pawl arm 11*a*. This is made possible as the blocking element 11 has already assumed its position, releasing the pawl comfort pawl 2. This is initially ensured by the drive 6 to 9 as described in detail below. The opening operation of the catch 1 and the disengagement of the pawl or comfort pawl 2 corresponds to the catch 1 carrying out the described clockwise movement around its axis 5 and is supported by the force of the spring, not shown.

Of special significance is the circumstance that the blocking element 11 is arranged on an edge which is averted from the rotary latch and also so as to laterally overlap the pawl 2. This means the blocking element 11 is located on an edge of the pawl 2, facing away from the catch 1. The edge facing away from the pawl is consequently opposite the edge of the pawl 2 facing the catch 1. This edge facing away from the pawl also contains said extension or spring extension 15 of the pawl 2.

The FIGURE also shows that the blocking element 11 on one hand and the pawl 2, on the other hand, laterally overlap, i.e. contain in a way a parallel extension to one another. In addition, the blocking element 11 is arranged between the electric motor 6 and the pawl 2 in the embodiment, so that the gap available at this point between the electric motor 6 and the pawl 2 is and can also be advantageously filled by the blocking element 11.

In contrast, the worm wheel 8 is arranged below the described elements 6, 11, 2, i.e. below the electric motor 6, of the blocking element 11 and then the pawl 2. In this way the blocking element 11 arranged at the centre or nearly at the centre between the electric motor 6 on one hand and the pawl 2 on the other hand can also easily provide the overlap with the worm wheel 8 with its stopping arm 11*b*, being also a prerequisite for the drive arm 11*b* acting and being able to act as a stop for the drive 6 to 9 or its radial projection 9 in the example.

As already explained, two pawls 2, 3 have been provided in the example, the pawl or comfort pawl 2 shown by a continuous line, on one hand and the pre-ratchet pawl 3 indicated by the dashed line, on the other hand. A multi-pawl or two-pawl locking mechanism 1, 2, 3 is therefore provided. In addition, the main ratchet 12 is located on the catch 1, interacting with the first pawl or comfort pawl 2. Apart from this one main ratchet 12 also a further pre-ratchet can be provided which is, however, not shown. Instead, the function of this pre-ratchet is carried out by a bolt 16 projecting from the catch 1 or a respective contour. The pre-ratchet pawl 3 interacts with the bolt 16 as soon as the catch 1 has reached its pre-ratchet position.

An electric opening operation is now initiated as follows. For this electric opening operation the electric motor 6 is first of all energized in such a way that, in the example, the worm wheel 8 makes a counter-clockwise movement around its own axis 10. The starting position not shown in detail can correspond to the radial projection 9 assuming a position at around 6 to 9 o'clock. This means that as part of the opening process the radial projection 9 makes an approximate 180° rotation in counter-clockwise direction in relation to the axis 10. During this process, a not explicitly shown release lever, engaging in the bearing point 13 is disengaged with the aid of the worm wheel 8. For reasons of clarity, this release lever is, in relation to the drawing plane shown on a further back plane The release lever acted upon by the drive 6 to 9, ensures in any case that the blocking element 11 is pivoted away from its engagement with the main ratchet 12 and in the direction of the arrow in counter-clockwise direction. This releases the pawl 2. The notch, i.e. the opening moment achieved by a specified arrangement of the bearing points 4, 5 of the pawl 2 and catch 1, now ensures that the locking mechanism opens automatically. The drive 6 and 9 and, in particular, the worm wheel 8 continue to turn until finally resting against the radial projection 9. By using a mechanical stop for the worm wheel 8, no elaborate controls for the electric motor 6 are required. In the simplest arrangement, the increased power take up on the motor 6 can be registered allowing the end position of the worm wheel 8 to be detected. The motor can then, for instance, be denergised.

During closing, the multi-pawl locking mechanism 1, 2, 3 and the pre-ratchet pawl 3 do engage with the bolt 16 on the catch 1 and the comfort pawl 2 engages with the main ratchet 12 of the catch 1.

At the start of the opening process the pre-ratchet pawl 3 is in any case pivoted away from its engaging option with pin 16. This pivoting movement on pre-ratchet pawl 3 corresponds at the same time to the blocking element 11 also being pivoted in counter-clockwise direction around its axis 13 with the aid of the release lever. In the main-ratchet position of the pawl or comfort pawl 2, the pawl arm 11*a* has, as is known, ensured by resting against the stop 14 of the comfort pawl 2 that the comfort pawl 2 will be held in the main ratchet 12 of the catch 1. If the release lever pivots the blocking element 11 from its seat between the pawl arm 11*a* and the stop 14 on the comfort pawl 2, the catch 1 opening as a result at the same time with the aid of a spring can exert the opening torque, described above, on the comfort pawl 2.

As a result, the comfort pawl 2 leaves the main ratchet 12 of the catch 1, moving away from it and releasing the catch 1, by itself and basically automatically due to the described "notch" This opening movement of the comfort pawl 2 is reduced or slowed down by the fact that at the end of this process, the spring extension 15 moves against the pawl arm 11*a* and that, as a result, the comfort pawl 2 is slowly decelerated. Very little force is required for releasing the comfort pawl 2 so that the locking mechanism consisting of catch 1, comfort pawl 2 and blocking element 11 easily opens with little noise.

In order to brake the movement of the drive 6 to 9 or of the worm wheel 8 in counterclockwise direction around the respective axis 10 or definitively stop the drive 6 to 9 during the described opening process, the radial projection 9 can then move against the drive arm 11*b* of the blocking element 11 and ensures that the drive 6 to 9 is slowed down.

As part of the invention, the stopping arm 11*b* and thus the stop for the drive 6 to 9 are not arranged on the blocking element 11 as shown in the drawing. Instead, the stopping arm 11*b* can in principle also be arranged on the pawl or comfort pawl. Alternatively, the drive arm 11*b* can also be formed on the pre-ratchet pawl 3.

The invention claimed is:

1. Motor vehicle door lock, having a locking mechanism comprising a catch and at least one pawl, as well as a drive for acting on the locking mechanism, and a blocking element interacting with the pawl with at least one pawl arm, holding the pawl in a detent position, and a stopping arm on the blocking element, acting as a stop for the drive, wherein the blocking element is arranged on an edge which is averted from the catch and also so as to laterally overlap the pawl, and wherein the pawl arm of the blocking element, in its position releasing the pawl, rests against a spring extension of the pawl.

2. Motor vehicle door lock according to claim 1, characterized in that the pawl arm and the stopping arm on the blocking element form an angle that approximates a right angle.

3. Motor vehicle door lock according to claim 1, characterized in that the stopping arm of the blocking element at least partially overlaps with a worm wheel of the drive.

4. Motor vehicle door lock according to claim 3, characterized in that the worm wheel contains a radial projection extending upwards from the worm wheel in consideration of a specified angle of rotation and at a certain radial distance in relation to an axis.

5. Motor vehicle door lock according to claim 1, characterized in that a first pawl and a second pawl are provided.

6. Motor vehicle door lock according to claim 5, characterized in that the blocking element interacts with the first pawl.

7. Motor vehicle door lock according to claim 5, characterized in that the two pawls are arranged in a plane above each other.

8. Motor vehicle door lock according to claim 1, wherein the catch further comprises a plurality of ratchets.

9. Motor vehicle door lock, having a locking mechanism comprising a catch and a multi-pawl mechanism with a comfort pawl and a pre-ratchet pawl, as well as a drive for acting on the locking mechanism, and a blocking element interacting with the comfort pawl with at least one pawl arm, holding the comfort pawl in a detent position, and a stopping arm on the blocking element acting as a stop for the drive, characterized in that the blocking element is arranged on an edge which is averted from the catch and also so as to laterally overlap the comfort pawl.

10. Motor vehicle door lock according to claim 9, characterized in that the pawl arm of the blocking element in its position releasing the comfort pawl, rests against an extension of the comfort pawl.

11. Motor vehicle door lock according to claim 10, characterized in that the extension is designed as a spring extension.

12. Motor vehicle door lock according to claim 9, characterized in that the stopping arm of the blocking element at least partially overlaps with a worm wheel of the drive.

13. Motor vehicle door lock according to claim 12, characterized in that the worm wheel contains a radial projection extending upwards from the worm wheel in consideration of a specified angle of rotation and at a certain radial distance in relation to an axis.

14. Motor vehicle door lock according to claim 9, characterized in that the comfort pawl and the pre-ratchet pawl are arranged in a plane above each other.

15. Motor vehicle door lock according to claim 9, wherein the pawl arm and the stopping arm on the blocking element form an angle that approximates a right angle.

16. Motor vehicle door lock according to claim 9, wherein the catch further comprises a plurality of ratchets.

17. Motor vehicle door lock according to claim 9, wherein the catch further comprises a pre-ratchet pin that engages the pre-ratchet pawl.

* * * * *